US005506744A

United States Patent [19]

Rush et al.

[11] Patent Number: 5,506,744

[45] Date of Patent: Apr. 9, 1996

[54] IONIZED AIRFLOW MANIFOLD FOR STATIC REDUCTION

[75] Inventors: John M. Rush, Mountain View; Torben Ulander, Sunnyvale; Michael T. Verdon, San Jose, all of Calif.

[73] Assignee: Fortrend Engineering, Sunnyvale, Calif.

[21] Appl. No.: 234,842

[22] Filed: Apr. 28, 1994

[51] Int. Cl.[6] ..... H05F 3/00

[52] U.S. Cl. ..... 361/220; 361/225

[58] Field of Search ..... 361/212, 213, 361/220, 225, 227, 228, 230, 231

[56] References Cited

U.S. PATENT DOCUMENTS

| | | | |
|---|---|---|---|
| 4,493,247 | 1/1985 | Wachsman | 361/231 |
| 4,827,371 | 5/1989 | Yost | 361/231 |
| 4,901,194 | 2/1990 | Steinman et al. | 361/231 |
| 5,065,272 | 11/1991 | Owen et al. | 361/231 |

*Primary Examiner*—Jeffrey A. Gaffin
*Attorney, Agent, or Firm*—Keith Kline

[57] ABSTRACT

An ionized airflow manifold for static reduction. The manifold may be installed in a stand-alone frame, or attached to any processing machine. The manifold includes a commercially available gas ionizer that provides an ionized air supply, and creates an air curtain around a target area.

2 Claims, 4 Drawing Sheets

IONIZED AIRFLOW MANIFOLD FOR STATIC REDUCTION

FIELD OF THE INVENTION

The present invention relates generally to devices that reduce static charges, and more particularly is an airflow manifold utilizing ionized air to eliminate static charges.

BACKGROUND OF THE INVENTION

One of the historical problems in semiconductor production facilities is the presences of static charges in the production areas. Electrostatic discharge (ESD) can directly damage wafers in process by interfering with their circuitry. Additionally, electrostatic charges can be damaging due to their tendency to attract and hold particulate contamination on the wafers in process. ESD can also affect the controlling circuitry of the process machines operating on wafers in a production line, thereby causing breakage and damage to the wafers.

For these reasons, many efforts have been directed at the elimination of ESD in the production area. One method of combatting ESD is the room ionizer, which ionizes the airflow supply in a cleanroom environment. While this method of reducing ESD damage is effective on operations that are conducted in an area where the airflow easily reaches the wafers, room ionizers are not effective in dealing with electrostatic charge that accumulates in the interiors of production tools.

Another serious shortcoming of the room ionizer as a means to eliminate ESD is that it is not effective for operations conducted in a "mini-environment". Mini-environments, which provide a contamination free area only immediately around the process area itself, preclude ionized air in the fab area from reaching the interior of the environment, where the parts are processed.

The biggest problem with current art technology is that it requires a great deal of time to eliminate static charge.

OBJECTS, SUMMARY, AND ADVANTAGES OF THE INVENTION

Accordingly, it is an object of the present invention to provide a means of static elimination in environments wherein there is no laminar airflow supply.

It is another object of the present invention to provide a device that can operate on any object to remove electrostatic charges.

The present invention is an ionized airflow manifold for static reduction. The manifold may be installed in a stand-alone frame, or attached to any processing machine. The manifold includes a commercially available gas ionizer that provides an ionized air supply.

A chief advantage of the manifold airflow of the present invention is that it reduces the time required to remove static charge by an order of magnitude.

Another advantage of the present invention is that it can be used in any operating environment to reduce the possibility of ESD damage to the workpieces.

A further advantage of the present invention is that it has no exposed emitter points.

These and other objects and advantages of the present invention will become apparent to those skilled in the art in view of the description of the best presently known mode of carrying out the invention as described herein and as illustrated in the drawings.

BEST MODE OF CARRYING OUT THE INVENTION

Figure 1:
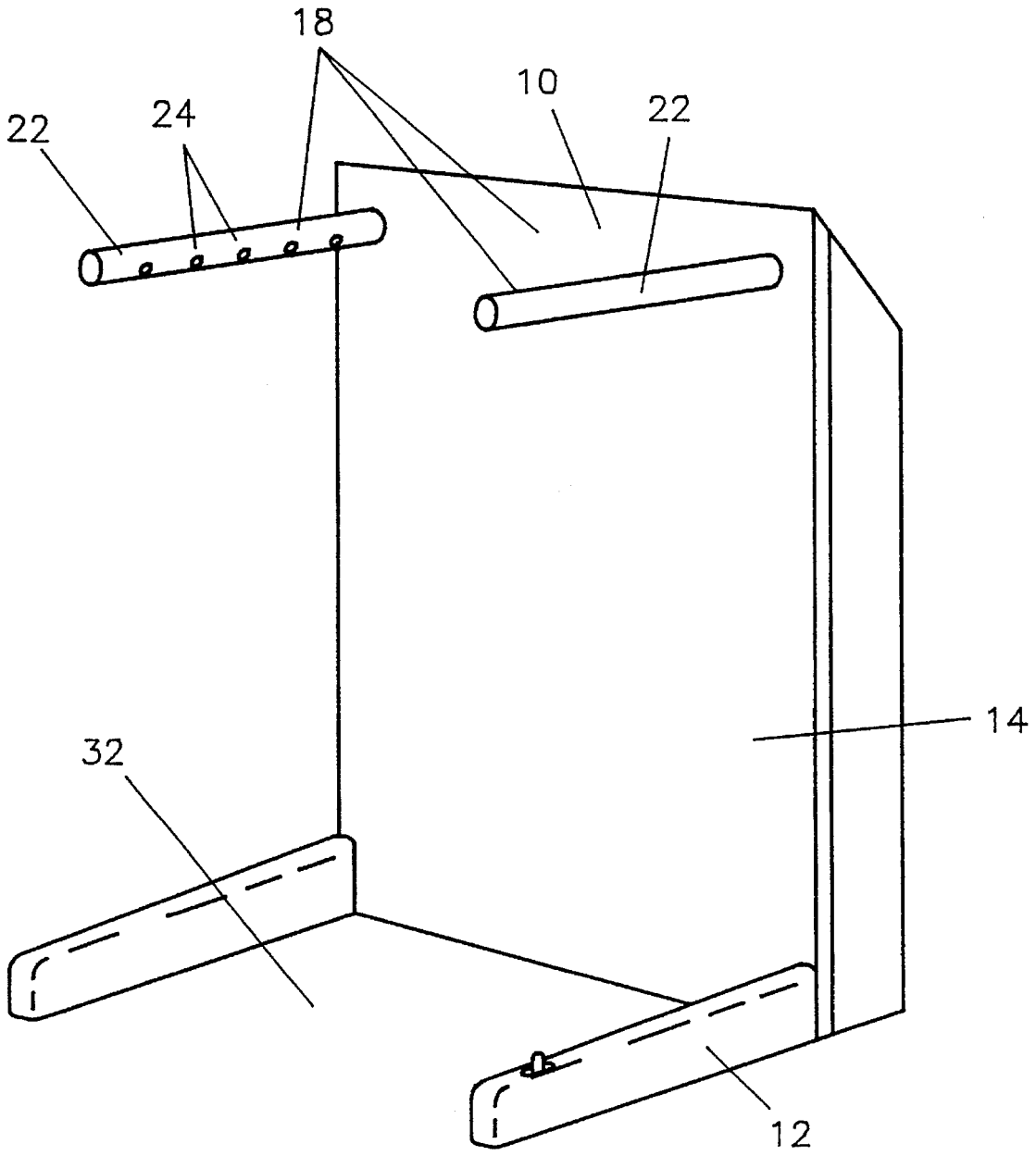
FIG. 1 is a perspective view of the stand-alone embodiment of the present invention.

Referring chiefly to FIG. 1, the present invention comprises an ionized airflow manifold 10. The manifold 10 is mounted on a base 12 which includes an upright bulkhead 14.

The manifold 10 includes a commercial ionizer 16 mounted on the bulkhead 14. The preferred source for ionizers 16 is Ion Systems, and in particular their Z-Stat Model 6110 Air Ionizing Cartridge.

The ionizer 16 is in communication with an airway 18 which extends through the interior of the bulkhead 14, and terminates in two horizontally extending rods 22. On the underside of each of the rods 22 is a series of ports 24 that allow ionized air to flow out of the airway 18 and to surround the workpiece or tool from which static is being removed. In this manner, an air curtain of ionized air is formed around the workpiece or tool.

It is envisioned that the ports 24 will be installed at a 45° angle from vertical. However, any angle desired by a user can be achieved by rotating the rods 22 within their mounting position in the bar 20.

Figure 2:
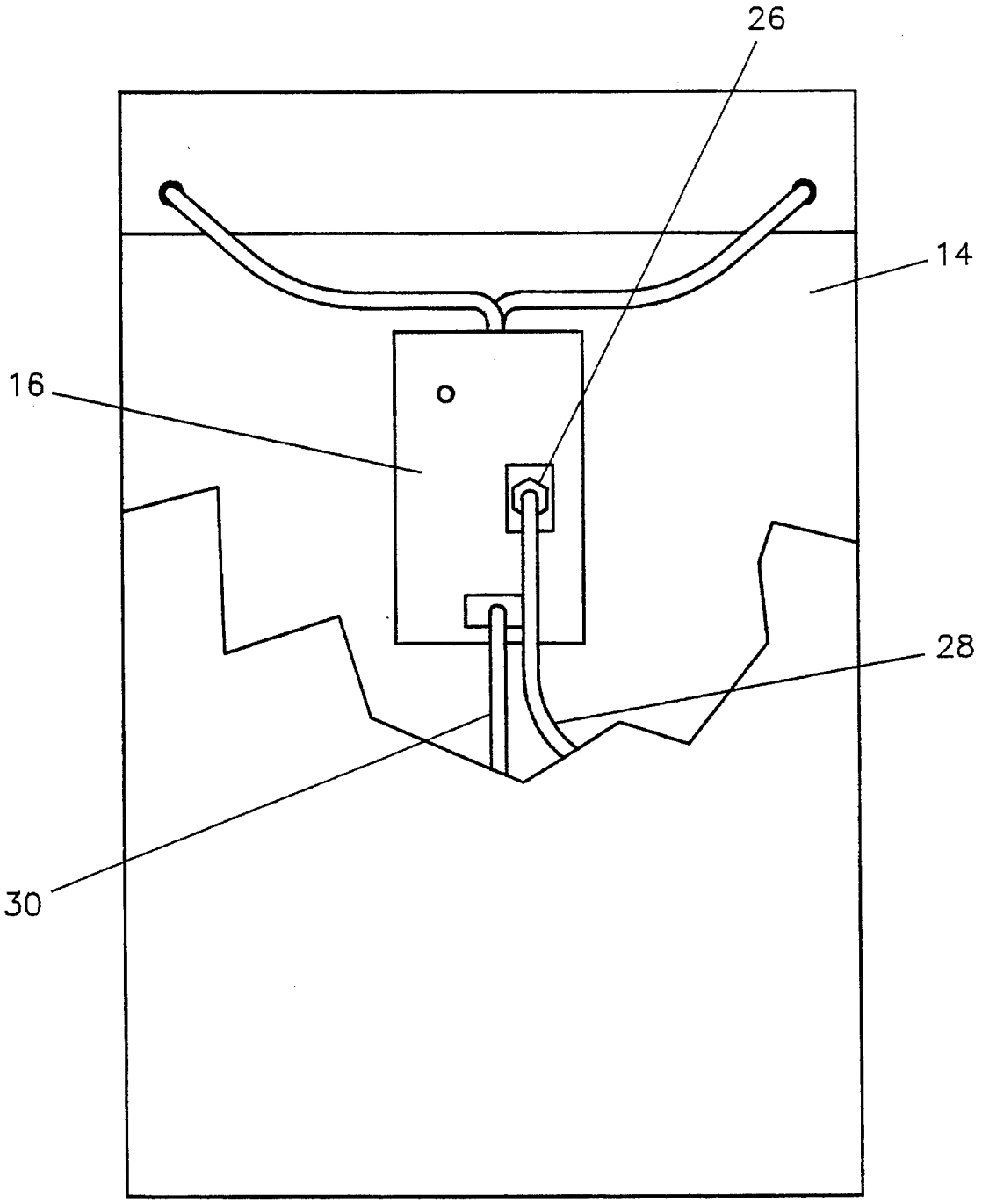
FIG. 2 is a rear perspective view of the stand-alone embodiment with the rear cover broken to show the ionizer.

A rear view of the device is shown in FIG. 2. This view shows that the requirements of the manifold include an air inlet coupling 26, an air supply line 28, and an electrical power line 30.

It is envisioned that the device of the present invention will generally be constructed from plastic, although aluminum could be used.

Operation of the device is as follows: Air flows through the supply line 28 into the ionizer 16. (It is assumed that the facility's house air supply is filtered, and that the flow of air can be controlled by the user). The ionizer supplies the air with polarity balanced ions. The charged air then flows through the airway 18 of the manifold 10 to the rods 22. The ionized air then flows out through the ports 24, where it creates an air shower over a target area 32.

The item or tool which the user desires to be cleared of static charge is placed onto the target area 32. The ionized air flows over the subject tool, neutralizing any static charge that is present.

Figure 3:
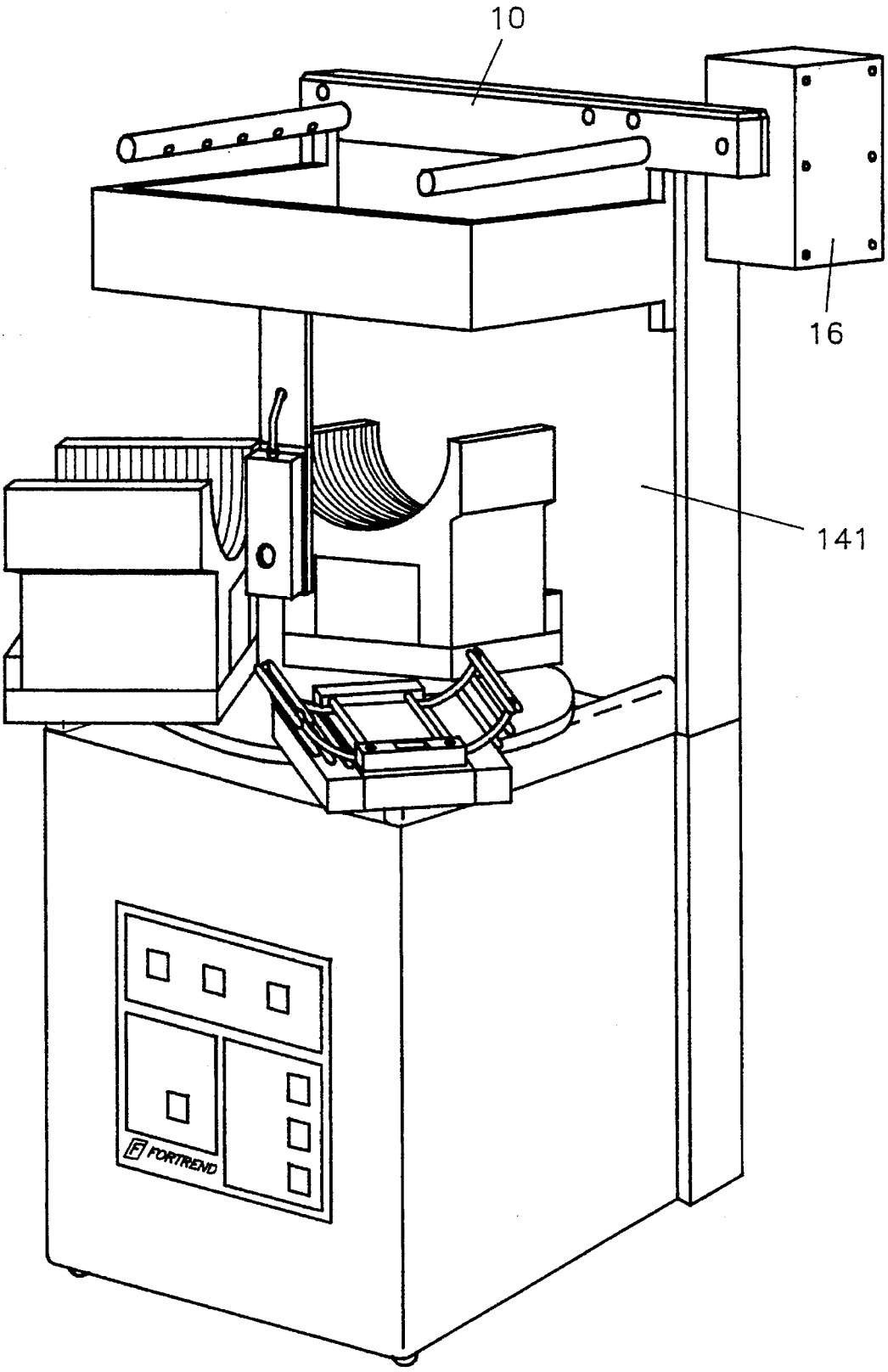
FIG. 3 is a perspective view of the airflow manifold installed on a processing machine.

The above description applies to the stand-alone embodiment of the ionized airflow manifold 10. It is envisioned that the manifold 10 will very often, if not most often, be utilized in an alternate embodiment as illustrated in FIG. 3.

The alternate embodiment of the manifold 10 is simply that the manifold is utilized in conjunction with a given piece of processing equipment. As shown in FIG. 3, the manifold can be fixed to the bulkhead 141 of a wafer transfer machine. Here, the manifold is shown installed on a Fortrend Engineering Rotary Transfer Machine.

Figure 4:
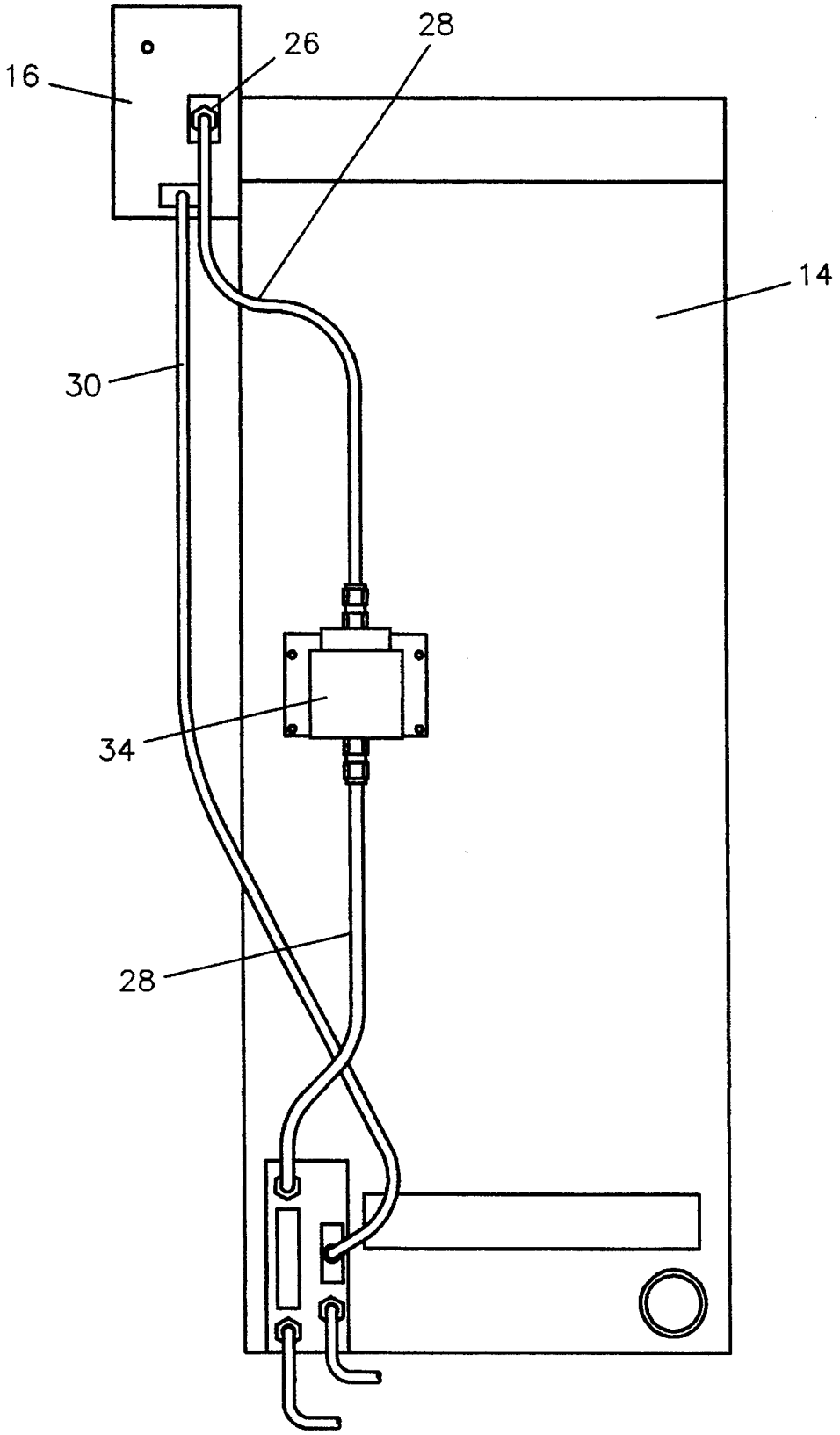
FIG. 4 is a rear perspective view of the device installed on a processing machine.

FIG. 4 shows the rear view of this installation. The flow of the air in the line 28 is controlled internally to the transfer machine. An in-line filter 34 is also provided.

Although the manifold can be installed on any piece of processing equipment, the transfer machine is the most advantageous due to the number of times the wafers are exposed to the transfer machine during the manufacturing process. Any charges generated during intermediate processing steps can be removed during a subsequent transfer operation.

A further option for the user will be the method for triggering airflow. The manifold of either embodiment can be installed to run continuously, or it can be set up to only operate when a wafer cassette is present in the target area. Means to measure the level of electrostatic charge could also be included. If this option were chosen, the airflow could be triggered only when the level of static charge exceeds a preset value.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

We claim:

1. An airflow manifold comprising:

an air supply line;

a mounting base;

a gas ionizer;

an airway terminating in extending bars; wherein air flows through the air supply line into the gas ionizer which is affixed to the base, the gas ionizer ionized the air, which then passes through the airway and into the extending bars which extend from the mounting base the extending bars having a plurality of ports therein through which the ionized air flows thereby creating an air shower around a target area that includes a means to support a workpiece.

2. An airflow manifold comprising:

an air supply line;

a mounting base;

a gas ionizer;

an airway terminating in extending bars; wherein air flows through the air supply line into the gas ionizer which is affixed to the base, the gas ionizer ionized the air, which then passes through the airway and into the extending bars which extend from the mounting base the extending bars having a plurality of ports therein through which the ionized air flows thereby creating an air shower around a target area that includes a means to support a workpiece; and wherein the manifold is mounted on a piece of manufacturing process equipment.

* * * * *